US008141654B2

(12) United States Patent
Lin

(10) Patent No.: US 8,141,654 B2
(45) Date of Patent: Mar. 27, 2012

(54) QUICK ASSEMBLY PNEUMATIC TOOL

(75) Inventor: Chen-Yang Lin, Ningbo (CN)

(73) Assignee: Ningbo Best Power Tools Co., Ltd., Zhejiang (CN)

( * ) Notice: Subject to any disclaimer, the term of this patent is extended or adjusted under 35 U.S.C. 154(b) by 350 days.

(21) Appl. No.: 12/578,567

(22) Filed: Oct. 13, 2009

(65) Prior Publication Data

US 2011/0083869 A1 Apr. 14, 2011

(51) Int. Cl.
*B25D 15/00* (2006.01)

(52) U.S. Cl. ..... 173/93.5; 173/93; 173/104; 173/168

(58) Field of Classification Search ..... 173/93, 173/93.5, 93.6, 104, 109, 213, 168, 169
See application file for complete search history.

(56) References Cited

U.S. PATENT DOCUMENTS 5,080,181 A * 1/1992 Tatsuno ..... 173/93.5
5,083,619 A * 1/1992 Giardino et al. ..... 173/93
5,954,141 A * 9/1999 Li et al. ..... 173/93.5
6,634,438 B1 * 10/2003 Pusateri et al. ..... 173/1
6,719,067 B2 * 4/2004 Taga ..... 173/93.5
6,883,619 B1 * 4/2005 Huang ..... 173/93.5
6,902,011 B2 * 6/2005 Hall ..... 173/169
7,174,971 B1 * 2/2007 Chen ..... 173/104
7,404,450 B2 * 7/2008 Izumisawa et al. ..... 173/93.5
7,594,550 B2 * 9/2009 Chen ..... 173/104

* cited by examiner

*Primary Examiner* — Scott A. Smith
(74) *Attorney, Agent, or Firm* — Hershkovitz & Associates, LLC; Abraham Hershkovitz

(57) ABSTRACT

A quick assembly pneumatic tool may be connected to a tool bit and has a housing, an anvil casing, a rear cover, an air inlet assembly, a rotor assembly and an impact assembly. The housing has a handle and a rotor casing. The rotor casing is formed on the handle and has a front chamber and a rear chamber. The anvil casing and rear cover respectively cover the front and rear chambers. The rotor assembly is mounted in the rear chamber and is selectively driven by the air inlet assembly. The impact assembly is mounted in the front chamber and the anvil casing and is selectively rotated by the rotor assembly. The separate rotor and anvil casings allow the rotor and impact assemblies to be inserted respectively in the front and rear chambers so that assembling the pneumatic is easy and quick.

10 Claims, 9 Drawing Sheets

QUICK ASSEMBLY PNEUMATIC TOOL

BACKGROUND OF THE INVENTION

1. Field of the Invention

The present invention relates to a tool, and more particularly to a quick assembly pneumatic tool that is convenient for assembly and maintenance.

2. Description of Related Art

Pneumatic or air-driven impact wrenches are extensively used to rapidly fasten or loosen bolts or nuts. A conventional pneumatic impact wrench has a housing, a rear cover, an air cylinder and an impact assembly.

The housing is formed as one piece and has a handle and a barrel. The handle has an air inlet and a trigger assembly. The air inlet is selectively connected to an air supply providing compressed air to the housing through the air inlet. The trigger assembly selectively opens or closes the inlet. The barrel is formed on and communicates with the handle and has a front end, a rear end and a chamber.

The rear cover is mounted on the rear end of the barrel to seal the chamber.

The air cylinder is mounted in the chamber and has a cylinder casing and a rotor. The cylinder casing is mounted securely in the chamber and has multiple air through holes defined therethrough to allow compressed air to enter the cylinder casing. The rotor is mounted rotatably in the cylinder casing and is driven to rotate by the compressed air.

The impact assembly is mounted in the chamber of the housing adjacent to the front end, is connected to the rotor and has a transmission member, an anvil and multiple hammers. The transmission member is connected to and selectively driven to rotate by the rotor. The anvil, also called a transmission shaft, is mounted longitudinally through the transmission member, protrudes out of the front end of the barrel and may be connected detachably to a tool bit such as screwdriver. The hammers are mounted pivotally on the transmission member and impact the anvil when the transmission member is rotated so that the impacted anvil acquires torque to substantially rotate synchronously with the rotor and the transmission member.

Because the housing is formed as one piece, the impact assembly and air cylinder need to be inserted into the chamber in turn through the rear end of the barrel. Such assembling frequently results in misalignment between the impact assembly and the air cylinder.

To overcome the shortcomings, the present invention provides a quick assembly pneumatic tool to mitigate or obviate the aforementioned problems.

SUMMARY OF THE INVENTION

The main objective of the invention is to provide a quick assembly pneumatic tool that is convenient for assembly and maintenance.

A quick assembly pneumatic tool in accordance with the present invention may be connected to a tool bit and has a housing, an anvil casing, a rear cover, an air inlet assembly, a rotor assembly and an impact assembly. The housing has a handle and a rotor casing. The rotor casing is formed on the handle and has a front chamber and a rear chamber. The anvil casing and rear cover respectively cover the front and rear chambers. The air inlet assembly is mounted in the handle. The rotor assembly is mounted in the rear chamber and is selectively driven by the air inlet assembly. The impact assembly is mounted in the front chamber and the anvil casing and is selectively rotated by the rotor assembly.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
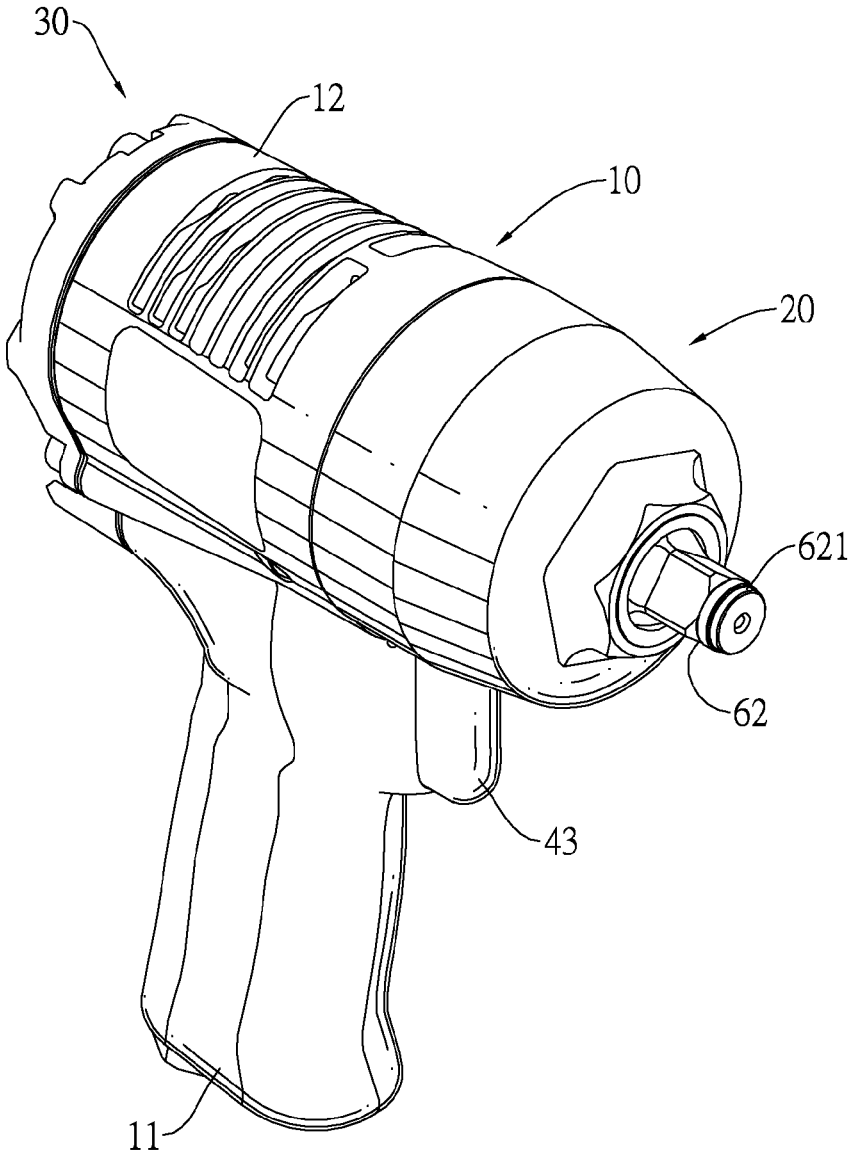
FIG. 1 is a perspective view of a quick assembly pneumatic tool in accordance with the present invention.
Figure 2:
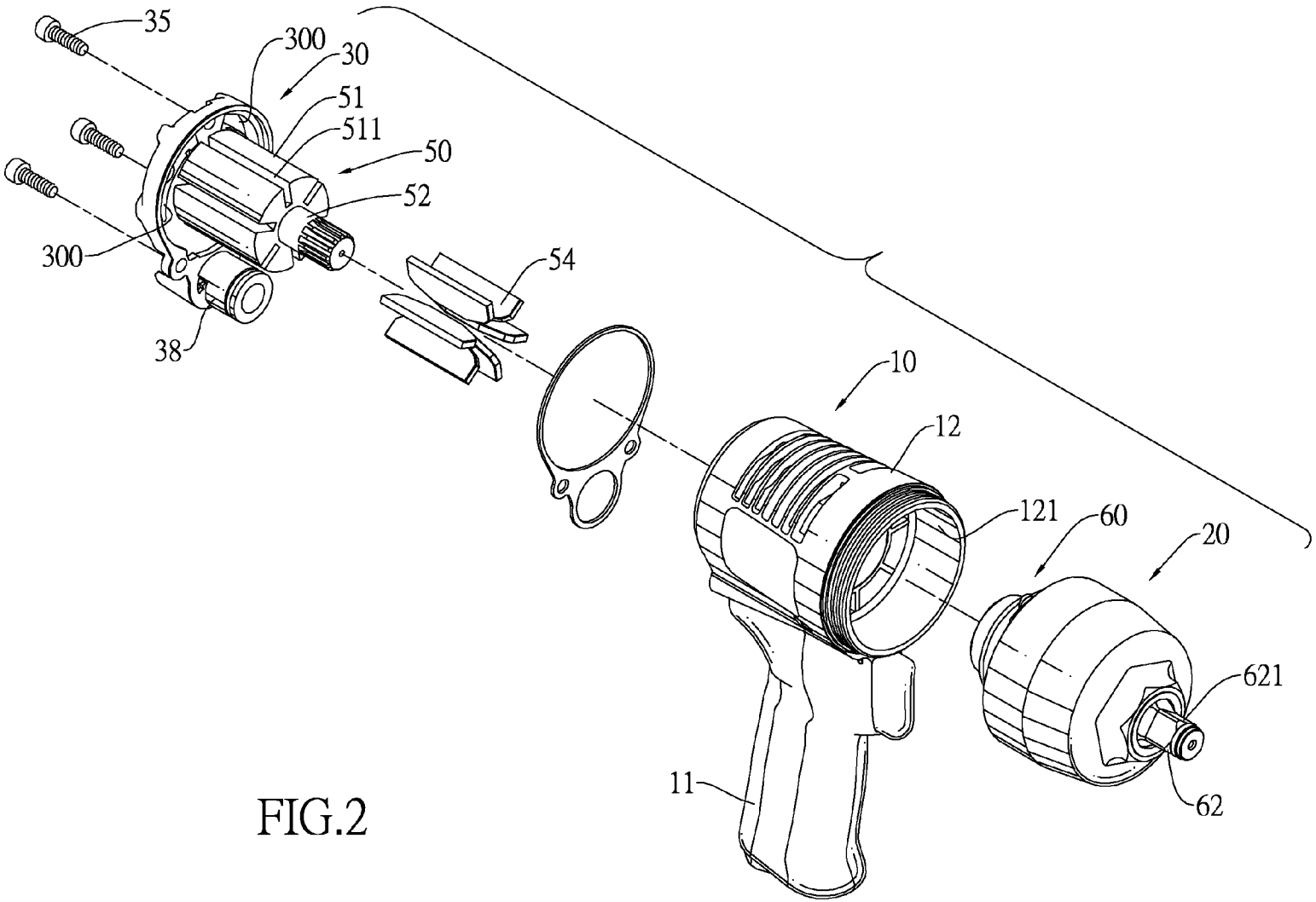
FIG. 2 is a partially exploded front perspective view of the quick assembly pneumatic tool in FIG. 1.
Figure 3:
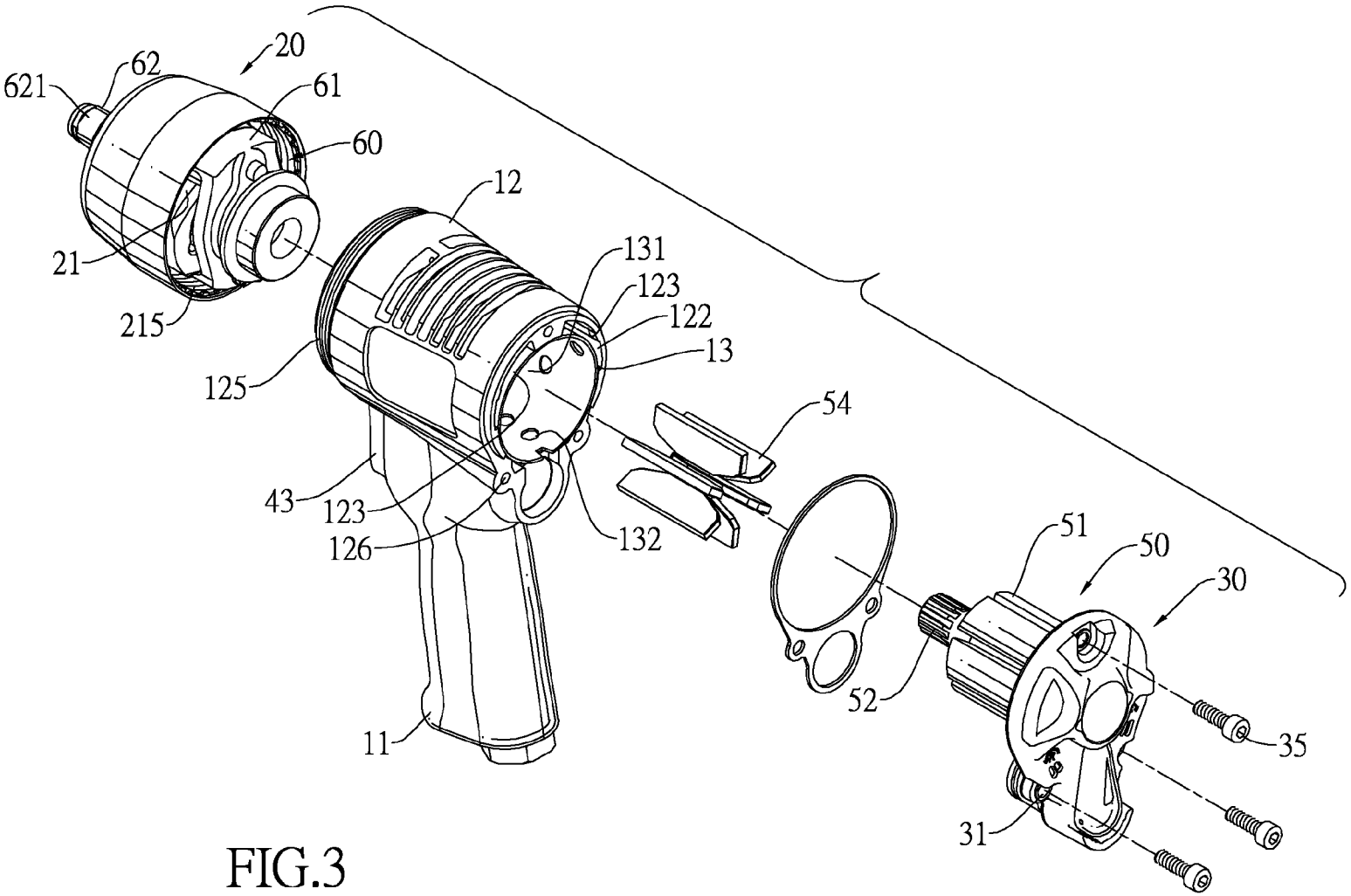
FIG. 3 is a partially exploded rear perspective view of the quick assembly pneumatic tool in FIG. 1.

With reference to FIGS. 1 to 3, a quick assembly pneumatic tool in accordance with the present application may be an impact wrench, may be connected to a tool bit such as screwdriver, socket or drill and comprises a housing (10), an anvil casing (20), a rear cover (30), an air inlet assembly (40), a rotor assembly (50) and an impact assembly (60).

The housing (10) has a handle (11) and a rotor casing (12).

The handle (11) has a bottom end, a top end and an air inlet channel defined in the handle (11).

Figure 5:
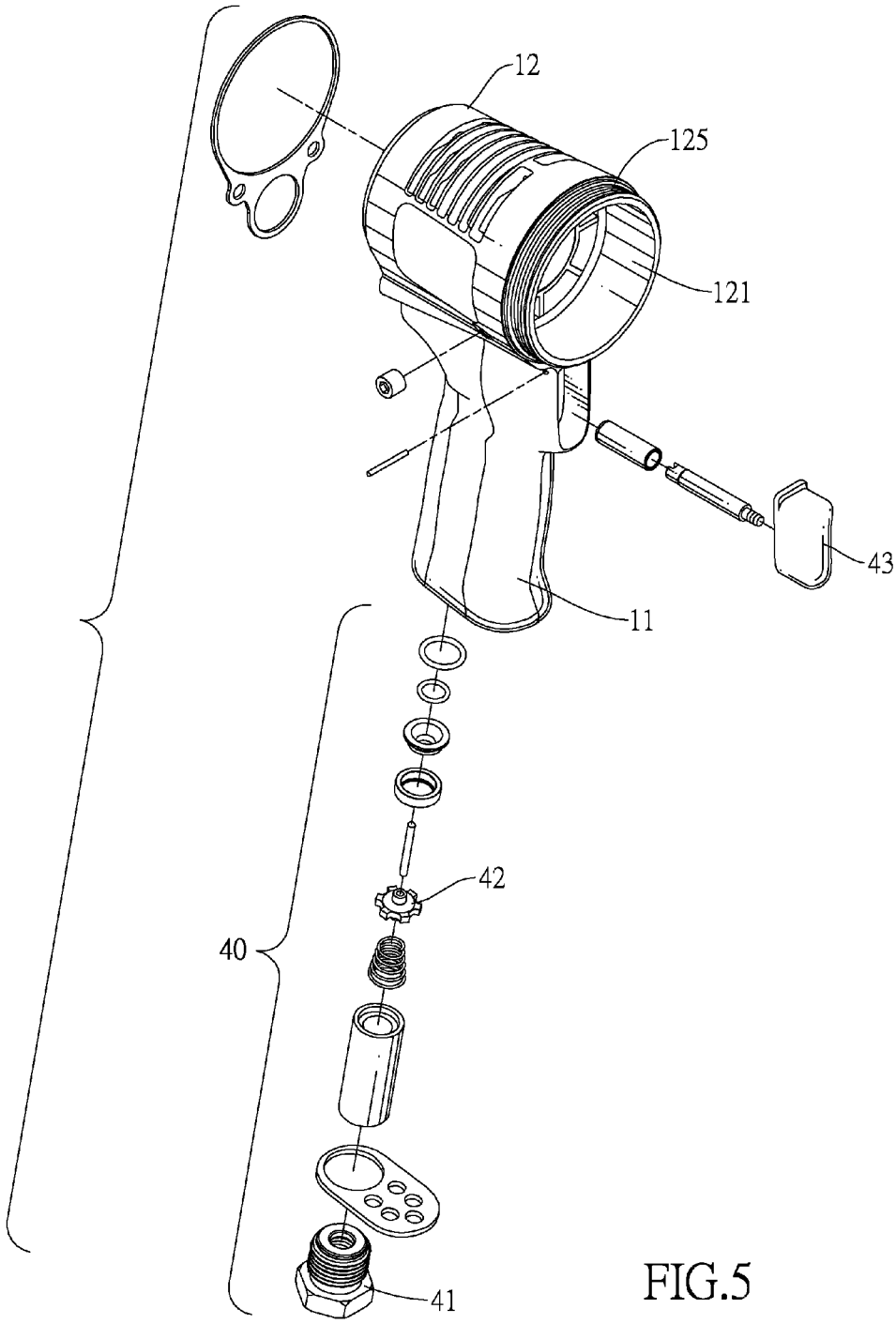
FIG. 5 is an enlarged and exploded perspective view of a housing and an air inlet assembly of the quick assembly pneumatic tool in FIG. 2.
Figure 7:
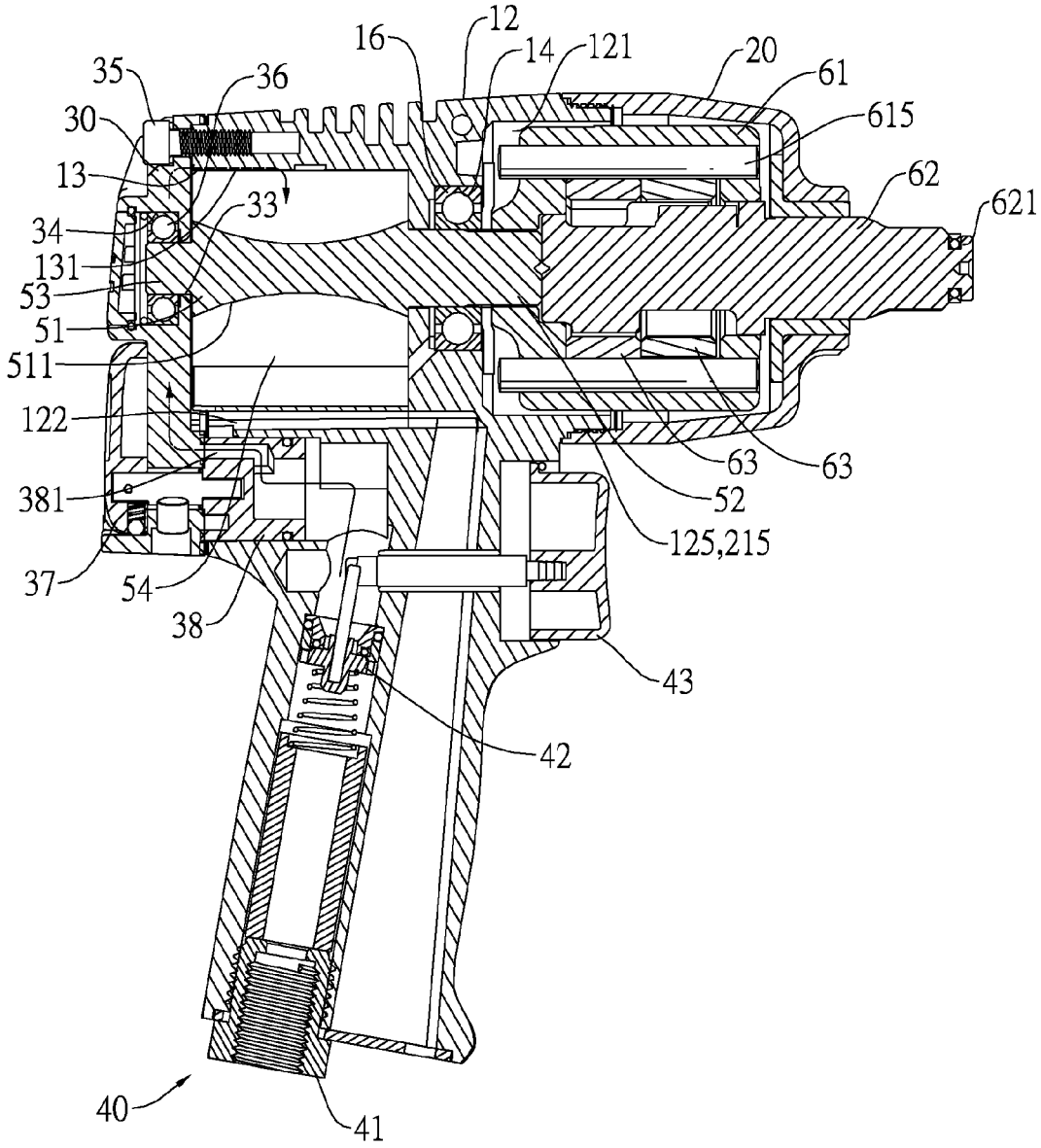
FIG. 7 is a side view in partial section of the quick assembly pneumatic tool in FIG. 1.

With further reference to FIGS. 5 and 7, the rotor casing (12) is formed on the top end of the handle (11) and has a front end, a rear end, a front chamber (121), a rear chamber (122), an engaging element (125), an air cylinder (13), multiple fastening holes (126), a partition and a front bearing (16).

The front chamber (121) is defined in the front end.

The rear chamber (122) is defined in the rear end, communicates with the air inlet channel of the handle (11) and has two airflow passages (123). The airflow passages (123) are defined in the rear chamber (122).

The engaging element (125) is formed around the front end and may be an outer thread.

The air cylinder (13) is formed integrally in the rear chamber (122) and has an internal chamber (131) and multiple apertures (132). The internal chamber (131) is defined in the air cylinder (13). The apertures (132) are defined through the air cylinder (13) and communicate with the rear chamber (122) and the internal chamber (131).

The fastening holes (126) are defined in the rear end and may be threaded.

The partition is formed between the front and rear chambers (121, 122) and has a through hole and a mounting recess (14). The through hole is defined through the partition. The mounting recess (14) is defined in the partition and communicates with the through hole.

The front bearing (16) is mounted in the mounting recess (14).

The anvil casing (20) is mounted detachably on the front end of the rotor casing (12), covers the front chamber (121) and has a front end, a rear end, an inner surface, a cavity (21), a mounting hole and an engaging member (215). The cavity (21) is defined in the rear end of the anvil casing (20) and communicates with the front chamber (121) of the rotor casing (12). The mounting hole is defined through the front end of the anvil casing (20). The engaging member (215) is formed on the inner surface, selectively engages with the engaging element (125) of the rotor casing (12) and may be an inner thread corresponding to the outer thread.

Figure 6:
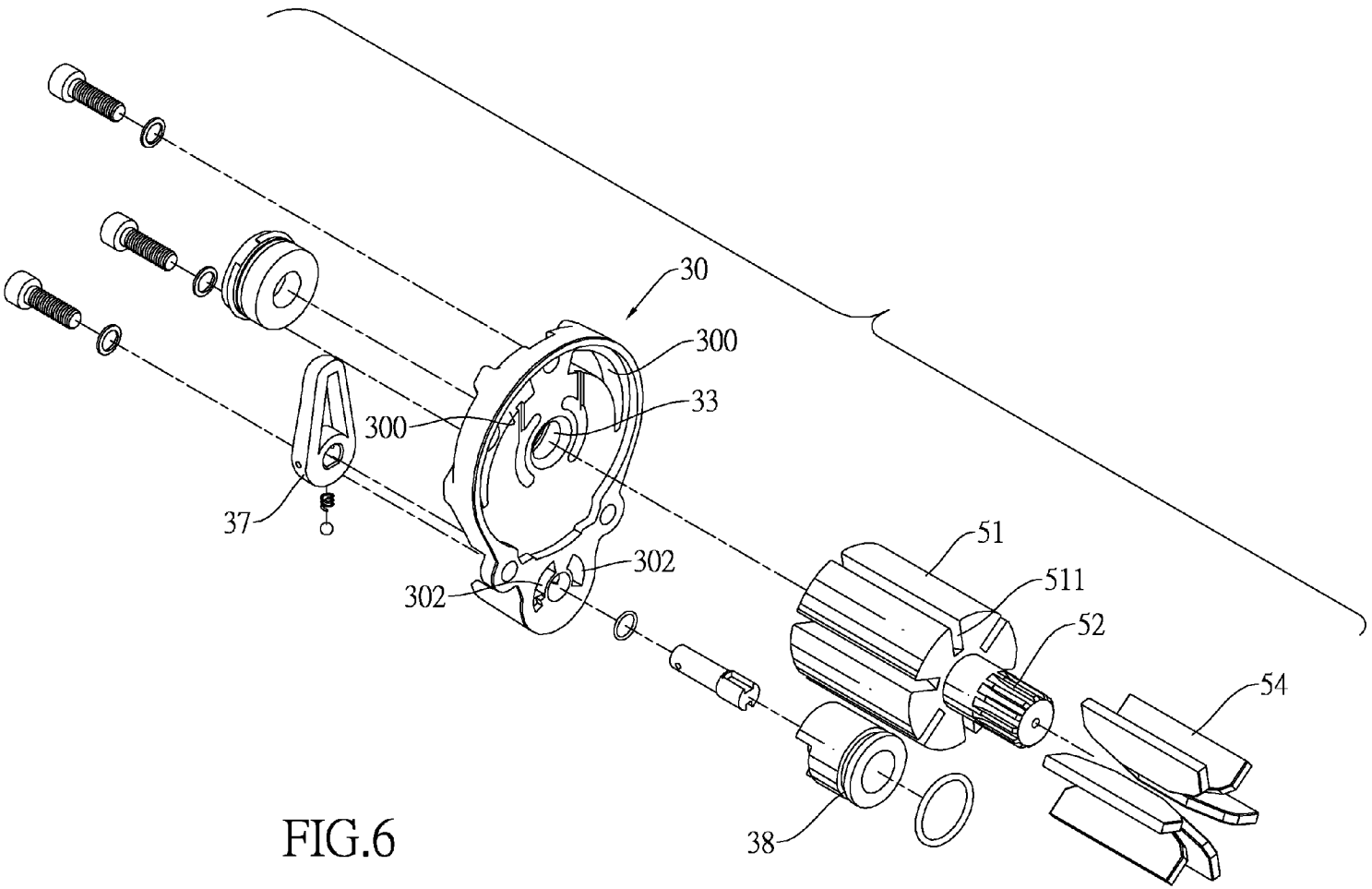
FIG. 6 is an enlarged and exploded perspective view of a rear cover and a rotor assembly of the quick assembly pneumatic tool in FIG. 2.

With further reference to FIG. 6, the rear cover (30) is mounted detachably on the rear end of the rotor casing (12), covers the rear chamber (122) and has a front, a rear, a shaft hole (33), two inlet holes (302), two outlet holes (300), multiple fastening holes (31), a bearing recess (34), multiple fasteners (35), a rear bearing (36), an airflow adjuster (38) and a switch lever (37).

The shaft hole (33) is defined through the rear cover (30).

The inlet holes (302) are defined in the front of the rear cover (30).

The outlet holes (300) are defined in the front above the inlet holes (302), respectively communicate with the inlet holes (302) and are respectively aligned with and communicate with the airflow passages (123) of the rear chamber (122) of the rotor casing (12).

The fastening holes (31) are defined through the rear cover (30).

The bearing recess (34) is defined in the rear cover (30).

The fasteners (35) may be bolts and are mounted respectively through the fastening holes (31) of the rear cover (30) and respectively through the fastening holes (126) of the rotor casing (12).

The rear bearing (36) may be a ball bearing, is mounted in the bearing recess (34).

The airflow adjuster (38) is mounted rotatably in the rotor casing (12) and has a passage. The passage is defined longitudinally through the airflow adjuster (38) as shown in FIG. 7, communicates with the air inlet channel of the handle (11) and the rear cover (30) and has an opening (381). The opening (381) selectively aligns with the one inlet hole (302) of the rear cover (30). Rotating the airflow adjuster (38) aligns the opening (381) with one inlet hole (302) of rear cover (30) so that high pressure air from the air inlet channel flows through one outlet passage (300) and one airflow passage (123) of the rotor chamber (12) to clockwise or counterclockwise rotate the rotor (50). Furthermore, an airflow rate of the rear chamber (122) is also changed by rotating airflow adjuster (38) to adjust a torque of the quick assembly pneumatic tool.

The switch lever (37) is mounted pivotally on the rear cover (30) and is connected to and selectively rotates the airflow adjuster (38) through a link. Thus, pivoting the switch lever (37) increases or decreases the power of the quick assembly pneumatic tool.

Figure 8:
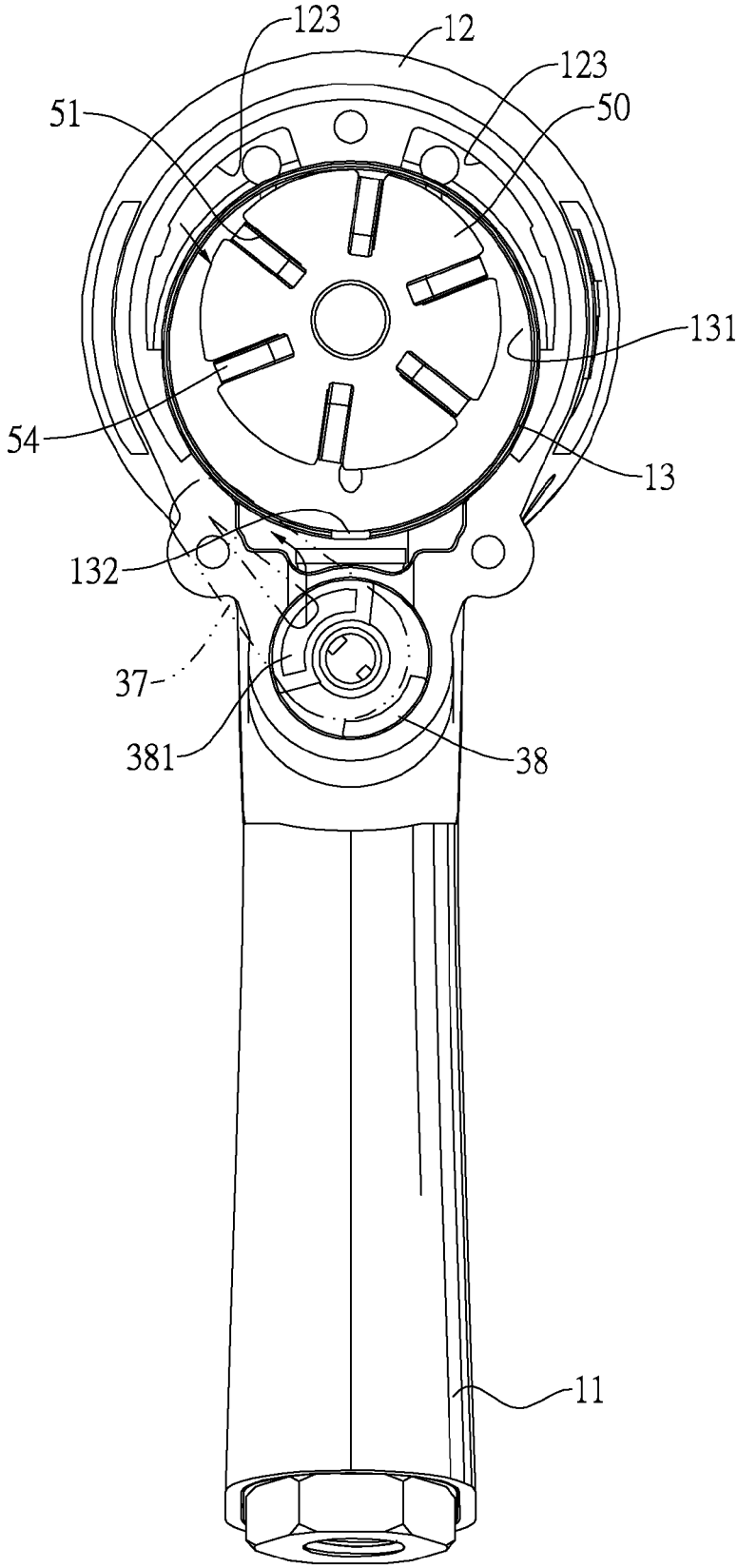
FIG. 8 is a rear view of the quick assembly pneumatic tool in FIG. 1 omitting the rear cover and showing the high pressure flow into the internal chamber to rotate the rotor counterclockwise.

With further reference to FIG. 8, counterclockwise pivoting the switch lever (37) rotates the airflow adjuster (38) to make one opening (381) of the passage communicate with one inlet hole (302) of the rear cover (30). The air flows through one outlet hole (300) and one airflow passage (123) and makes high pressure air flow counterclockwise into the internal chamber (131) of the air cylinder (13). Therefore, the rotor (50), the impact assembly (60) and the tool bit are driven to rotate counterclockwise.

Figure 9:
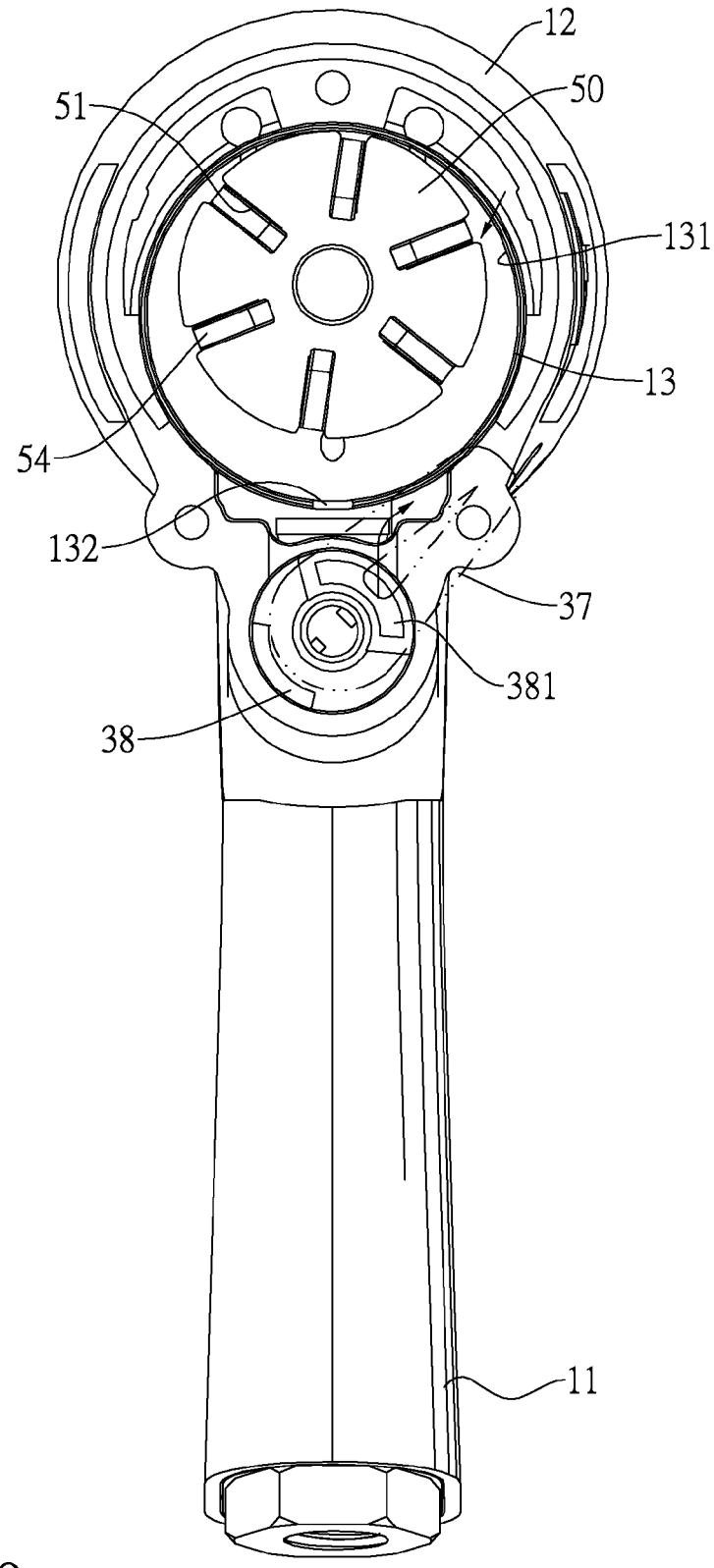
FIG. 9 is a rear view of the quick assembly pneumatic tool in FIG. 1 omitting the rear cover and showing the high pressure flow into the internal chamber to rotate the rotor clockwise.

With further reference to FIG. 9, clockwise pivoting the switch lever (37) rotates the airflow adjuster (38) to make the other opening (381) of the passage communicate with the other inlet hole (302) of the rear cover (30). The air flows through the other outlet hole (300) and the other airflow passage (123) and makes high pressure air flow clockwise into the internal chamber (131) of the air cylinder (13). Therefore, the rotor (50), the impact assembly (60) and the tool bit are driven to rotate clockwise.

The air inlet assembly (40) is mounted in the handle (11) of the housing (10) and has a connecting bushing (41), an inlet valve (42) and a trigger (43).

The connecting bushing (41) is mounted in an air inlet channel adjacent to the bottom end of the handle (11).

The inlet valve (42) is mounted in and selectively opens or closes the air inlet channel.

The trigger (43) is mounted on the handle (11), is connected to and selectively drives the inlet valve to open or close the air inlet channel.

The rotor assembly (50) may be similar to conventional rotor assembly, is mounted in the rotor casing (12) and has a rotor (51) and multiple blades (54).

The rotor (51) is mounted rotatably in the internal chamber (131) of the air cylinder (13), is selectively driven by the air inlet assembly and has multiple slots (511), a front shaft (52) and a rear shaft (53). The slots (511) are defined radially in the rotor (51). The front shaft (52) may be geared, is formed on and protrudes forward from the rotor (51) and extends through the through hole of the partition and the front bearing (16). The rear shaft (53) is formed on and protrudes backward from the rotor (51) and extends through the shaft hole (33) and the rear bearing (36) of the rear cover (30).

The blades (54) are mounted respectively in and selectively extend out of the slots (511) so that compressed air flowing into the internal chamber (13) hits and drives the blades (54) to rotate the rotor (51).

Figure 4:
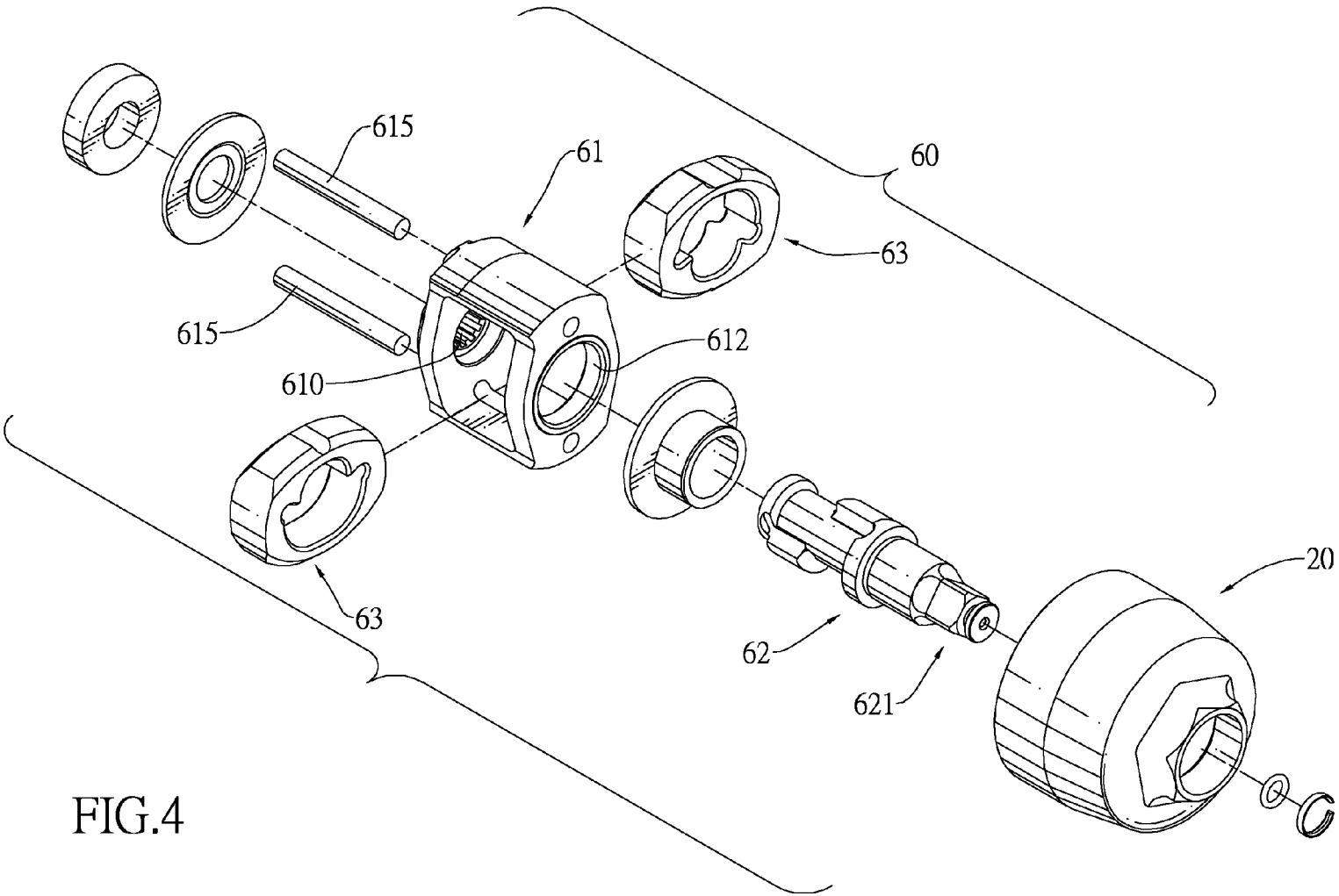
FIG. 4 is an enlarged and exploded perspective view of an anvil casing and an impact assembly of the quick assembly pneumatic tool in FIG. 2.

With further reference to FIG. 4, the impact assembly (60) may be similar to conventional impact assemblies, is mounted in the front chamber (121) of the rotor casing (12) and in the cavity (21) of the anvil casing (20), is selectively driven by the rotor (51) to rotate and has a transmission member (61), an anvil (62) and multiple hammers (63).

The transmission member (61) is mounted rotatably in the front chamber (121), is connected to and selectively driven by the rotor (51) to rotate and has a front end, a rear end, a room, a connecting hole (610), an front opening (612) and two rods (615). The room is defined in the transmission member (61). The connecting hole (610) may be geared, is defined in the rear end of the transmission member (61) and engages with the front shaft (52) of the rotor (51). The front opening (612) is defined through the front end of the transmission member (61). The rods (615) are mounted securely in the room.

The anvil (62) is mounted longitudinally in the room of the transmission member (61) through the front opening (612), extends rotatably through the mounting hole of the anvil casing (20) and has a head (621) selectively connected to the tool bit.

The hammers (63) are mounted in the room of the transmission member (61), are pivotally connected to the rods (615) and are mounted around and selectively knock and rotate the anvil (62). When the rotor (65) drives the transmission member (61) to rotate, the hammers (63) are pivoted by centrifugal forces applied thereto to impact and rotate the anvil (62).

The quick assembly pneumatic tool has the following advantages.

1. The anvil casing (20) and the rotor casing (12) are separate components detachably attached to each other instead of being formed integrally so that assembling the rotor assembly (50) and the impact assembly (60) is convenient. When the pneumatic tool is assembled, the rotor assembly (50) is mounted in the rear chamber (12) through the rear end of the rotor casing (12) and cover by the rear cover (30). The impact assembly (60) is mounted in the front chamber (11) through the front end of the rotor casing (12), easily and quickly aligns with the front shaft (52) on the partition and then covered by the anvil casing (20).

2. Because the rotor assembly (50) and the impact assembly (60) are mounted respectively through the front and rear ends of the rotor casing (12) instead of being inserted through the rear end of the rotor casing (12) in turn. The air cylinder (13) may be designed to be formed in the rear chamber (122) without structural interference due to different diameters of the air cylinder (13) and the impact assembly (60). Therefore, assembling the quick assembly pneumatic tool is easy.

3. The rear bearing (36) is mounted directly in the rear cover (30) without employing bearing mounts or brackets, which simplifies the assembly of the quick assembly pneumatic tool.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A quick assembly pneumatic tool comprising:

a housing having a handle and a rotor casing formed on the handle and having a front end and a rear end and further having a front chamber defined in the front end;

a rear chamber defined in the rear end; and an engaging element formed on the front end; and an air cylinder formed integrally in the rear chamber and having an internal chamber defined in the air cylinder;

an anvil casing detachably mounted on the front end of the rotor casing, covering the front chamber, having a front end, a rear end and further having a cavity defined in the rear end of the casing; and an engaging member formed on the rear end of the anvil and selectively engaging with the engaging element;

a rear cover mounted detachably on the rear end of the rotor casing and covering the rear chamber;

an air inlet assembly mounted on the handle;

a rotor assembly mounted in the rotor casing and having a rotor mounted rotatably in the internal chamber and selectively driven by the air inlet assembly; and an impact assembly mounted in the front chamber of the rotor casing and the cavity of the anvil casing, selectively driven by the rotor to rotate and having an anvil mounted through the anvil casing.

2. The quick assembly pneumatic tool as claimed in claim 1, wherein the rotor casing further has a partition formed between the front and rear chambers and having a through hole defined through the partition and a mounting recess defined in the partition;

the rear cover further has a shaft hole defined through the rear cover; and a bearing recess defined in the rear cover;

the rotor has a front shaft formed on and protruding forward from the rotor and extending through the through hole of the partition; and a rear shaft formed on and protruding backward form the rotor and extending through the shaft hole.

3. The quick assembly pneumatic tool as claimed in claim 2, wherein the rotor casing further has multiple fastening holes defined in the rear end;

the rear cover further has multiple fastening holes defined through the rear cover and multiple fasteners mounted respectively through the fastening holes of the rear cover and respectively through the fastening holes of the rotor casing.

4. The quick assembly pneumatic tool as claimed in claim 3, wherein the rotor casing further has a front bearing mounted in the mounting recess of the partition and mounted around the front shaft of the rotor; and the rear cover further has a rear bearing mounted in the bearing recess and mounted around the rear shaft of the rotor.

5. The quick assembly pneumatic tool as claimed in claim 4, wherein the rotor further has multiple slots defined radially in the rotor; and the rotor assembly further multiple blades mounted respectively in and selectively extending out of the slots.

6. The quick assembly pneumatic tool as claimed in claim 5, wherein the handle of the housing further has an air inlet channel defined in the handle;

the air inlet assembly has a connecting bushing mounted in the air inlet channel;

an inlet valve mounted in and selectively opening or closing the air inlet channel; and a trigger mounted on the handle and connected to and selectively driving the inlet valve to open or close the air inlet channel.

7. The quick assembly pneumatic tool as claimed in claim 6, wherein the rear chamber of the rotor casing further has two airflow passages defined in the rear chamber; and the rear cover further has two inlet holes defined in the front;

two outlet holes defined in the front above the inlet holes, respectively communicating with the inlet holes and respectively aligned with and communicating with the airflow passages of the rear chamber of the rotor casing;

an airflow adjuster mounted rotatably in the rotor casing and having a passage defined longitudinally through the airflow adjuster and communicating with the air inlet channel of the handle and the rear cover; and a switch lever mounted pivotally on the rear cover and connected to and selectively rotating the airflow adjuster.

8. The quick assembly pneumatic tool as claimed in claim 7, wherein the impact assembly further has a transmission member mounted rotatably in the front chamber, connected to and selectively driven by the rotor and having a front end and a rear end and further having a room defined in the transmission member;

a connecting hole defined in the rear end of the transmission member and engaging with the front shaft of the rotor;

a front opening defined through the front end of the transmission member so that the anvil is mounted in the room and extends through the front opening; and two rods mounted securely in the room;

multiple hammers mounted in the room of the transmission member, pivotally connected to the rods and mounted around and selectively knocking and rotating the anvil.

9. The quick pneumatic tool as claimed in claim 8, wherein the air cylinder has multiple apertures defined in through the air cylinder and communicating with the rear chamber and the internal chamber.

10. The quick pneumatic tool as claimed in claim 7, wherein the passage of the airflow adjuster has an opening selectively aligning with one inlet hole of the rear cover;

the switch lever is selectively pivoted counterclockwise or clockwise to make the opening of the passage communicate with one inlet hole of the rear cover.

* * * * *